US007726092B1

(12) United States Patent
Pelfrey et al.

(10) Patent No.: US 7,726,092 B1
(45) Date of Patent: Jun. 1, 2010

(54) WINDOW SILL AND TRIM CORNER ASSEMBLY

(75) Inventors: Paul R. Pelfrey, Wheelersburg, OH (US); Jan E. Byer, Canal Winchester, OH (US)

(73) Assignee: The Crane Group Companies Limited, Columbus, OH (US)

( * ) Notice: Subject to any disclaimer, the term of this patent is extended or adjusted under 35 U.S.C. 154(b) by 255 days.

(21) Appl. No.: 10/963,989

(22) Filed: Oct. 12, 2004

Related U.S. Application Data

(60) Provisional application No. 60/510,744, filed on Oct. 9, 2003.

(51) Int. Cl.

| | |
|---|---|
| ***E04C 2/38*** | (2006.01) |
| ***E06B 3/00*** | (2006.01) |
| ***E06B 1/04*** | (2006.01) |
| ***E04B 2/00*** | (2006.01) |
| ***E04C 1/00*** | (2006.01) |

(52) U.S. Cl. ..... 52/717.01; 52/656.5; 52/204.5; 52/288.1; 52/211; 52/309.9

(58) Field of Classification Search ..... 52/717.01, 52/730.3, 734.1, 656.5, 656.6, 309.4, 309.8, 52/528, 536, 537, 538, 288.1, 309.9, 211, 52/204.5; D25/119; 403/231, 401, 403
See application file for complete search history.

(56) References Cited

U.S. PATENT DOCUMENTS

| | | | | | |
|---|---|---|---|---|---|
| 1,589,675 | A | | 6/1926 | Belding | 52/522 |
| 1,728,934 | A | | 9/1929 | Hogenson | 206/322 |
| 2,510,845 | A | * | 6/1950 | Waters et al. | 49/460 |
| 2,617,502 | A | * | 11/1952 | Kessler | 403/231 |
| 2,697,932 | A | * | 12/1954 | Goodwin | 52/97 |
| 2,830,546 | A | | 4/1958 | Rippe | 108/17 |
| D196,230 | S | | 9/1963 | Raftery et al. | D13/1 |
| 3,139,703 | A | * | 7/1964 | Hilt | 52/97 |
| 3,159,943 | A | | 12/1964 | Sugar et al. | 50/200 |
| 3,233,382 | A | | 2/1966 | Graveley, Jr. | 52/522 |
| 3,246,436 | A | | 4/1966 | Roush | 52/303 |
| 3,289,365 | A | | 12/1966 | McLaughlin et al. | 52/173 |
| 3,289,380 | A | | 12/1966 | Charniga, Jr. | 52/716 |
| 3,325,952 | A | | 6/1967 | Trachtenberg | 52/276 |
| D208,251 | S | | 8/1967 | Facer | D13/1 |
| 3,387,418 | A | | 6/1968 | Tyrer | 52/242 |
| 3,399,916 | A | | 9/1968 | Ensor | 287/189.36 |
| 3,473,274 | A | | 10/1969 | Godes | 52/127 |
| 3,520,099 | A | | 7/1970 | Mattes | 52/531 |
| 3,552,078 | A | | 1/1971 | Mattes | 52/520 |
| 3,555,762 | A | | 1/1971 | Costanzo, Jr. | 52/588 |
| 3,605,356 | A | * | 9/1971 | Bordner | 52/97 |
| 3,637,459 | A | | 1/1972 | Parish et al. | 161/161 |
| 3,703,795 | A | | 11/1972 | Mattes | 52/521 |
| 3,815,310 | A | | 6/1974 | Kessler | 52/531 |

(Continued)

FOREIGN PATENT DOCUMENTS

| | | |
|---|---|---|
| CA | 96829 | 8/2002 |

(Continued)

*Primary Examiner*—Richard E Chilcot, Jr.
*Assistant Examiner*—Ryan D Kwiecinski
(74) *Attorney, Agent, or Firm*—Standley Law Group LLP

(57) ABSTRACT

The present invention is a window sill and trim corner assembly. The window sill and trim corner assembly may extend around a window or other opening in a structure.

12 Claims, 7 Drawing Sheets

U.S. PATENT DOCUMENTS

| | | | | |
|---|---|---|---|---|
| 3,826,054 | A | 7/1974 | Culpepper, Jr. | 52/309 |
| 3,906,699 | A * | 9/1975 | Leddy | 52/712 |
| 3,969,866 | A | 7/1976 | Kyne | 52/588 |
| 3,970,502 | A | 7/1976 | Turner | 156/310 |
| 4,001,997 | A | 1/1977 | Saltzman | 52/521 |
| 4,033,802 | A | 7/1977 | Culpepper, Jr. et al. | 156/71 |
| 4,034,528 | A | 7/1977 | Sanders et al. | 52/309.4 |
| 4,048,101 | A | 9/1977 | Nakamachi et al. | |
| 4,081,939 | A | 4/1978 | Culpepper, Jr. et al. | 52/535 |
| 4,096,011 | A | 6/1978 | Sanders et al. | 156/196 |
| 4,102,106 | A | 7/1978 | Golder et al. | 52/533 |
| 4,104,841 | A | 8/1978 | Naz | 52/519 |
| 4,118,166 | A | 10/1978 | Bartrum | 425/462 |
| 4,188,762 | A | 2/1980 | Tellman | 52/541 |
| 4,189,885 | A | 2/1980 | Fritz | 52/287 |
| 4,272,576 | A | 6/1981 | Britson | 428/100 |
| 4,279,106 | A | 7/1981 | Gleason et al. | 52/100 |
| 4,319,439 | A | 3/1982 | Gussow | 52/288 |
| 4,320,613 | A | 3/1982 | Kaufman | 52/521 |
| 4,327,528 | A | 5/1982 | Fritz | 52/309.1 |
| 4,389,824 | A | 6/1983 | Anderson | 52/211 |
| 4,424,655 | A | 1/1984 | Trostle | 52/520 |
| 4,429,503 | A | 2/1984 | Holliday | 52/410 |
| 4,450,665 | A | 5/1984 | Katz | 52/522 |
| D274,947 | S | 7/1984 | Culpepper, Jr. et al. | D25/73 |
| 4,492,064 | A | 1/1985 | Bynoe | |
| 4,506,486 | A | 3/1985 | Culpepper, Jr. et al. | 52/529 |
| 4,593,512 | A | 6/1986 | Funaki | 52/519 |
| 4,608,800 | A | 9/1986 | Fredette | 52/656 |
| 4,649,008 | A | 3/1987 | Johnstone et al. | 264/177.1 |
| D291,249 | S | 8/1987 | Manning | D25/73 |
| 4,694,628 | A | 9/1987 | Vondergoltz et al. | 52/528 |
| 4,709,519 | A | 12/1987 | Liefer et al. | 52/98 |
| 4,716,645 | A | 1/1988 | Pittman et al. | 29/527.1 |
| 4,782,638 | A | 11/1988 | Hovind | 52/547 |
| 4,814,413 | A | 3/1989 | Thibaut et al. | 528/80 |
| 4,843,790 | A | 7/1989 | Taravella | 52/211 |
| 4,856,975 | A | 8/1989 | Gearhart | 425/131.1 |
| 4,864,788 | A | 9/1989 | Tippmann | 52/309.8 |
| 4,911,628 | A | 3/1990 | Heilmayr et al. | 425/131.1 |
| 4,920,709 | A | 5/1990 | Garries et al. | 52/85 |
| 4,930,287 | A | 6/1990 | Volk et al. | 52/748 |
| 4,962,622 | A | 10/1990 | Albrecht et al. | 52/630 |
| 4,969,302 | A | 11/1990 | Coggan et al. | 52/309.8 |
| D316,299 | S | 4/1991 | Hurlburt | D25/119 |
| 5,016,415 | A | 5/1991 | Kellis | 52/522 |
| 5,022,204 | A * | 6/1991 | Anderson | 52/211 |
| 5,022,207 | A | 6/1991 | Hartnett | 52/537 |
| 5,024,045 | A | 6/1991 | Fluent et al. | 53/443 |
| 5,050,357 | A | 9/1991 | Lawson | 52/314 |
| 5,080,950 | A | 1/1992 | Burke | 428/81 |
| 5,090,174 | A * | 2/1992 | Fragale | 52/309.9 |
| 5,103,612 | A | 4/1992 | Wright | 52/288 |
| 5,224,315 | A | 7/1993 | Winter, IV | 52/309.8 |
| 5,230,377 | A | 7/1993 | Berman | 160/327 |
| D342,579 | S | 12/1993 | Mason | D25/119 |
| 5,282,344 | A | 2/1994 | Moore | 52/716.8 |
| 5,303,525 | A | 4/1994 | Magee | 52/306 |
| 5,306,548 | A | 4/1994 | Zabrocki et al. | 428/215 |
| 5,318,737 | A | 6/1994 | Trabert et al. | 264/171 |
| 5,347,784 | A | 9/1994 | Crick et al. | 52/520 |
| 5,363,623 | A | 11/1994 | King | 52/520 |
| 5,387,381 | A | 2/1995 | Saloom | |
| 5,415,921 | A | 5/1995 | Grohman | 428/216 |
| D361,138 | S | 8/1995 | Moore et al. | D25/119 |
| 5,443,878 | A | 8/1995 | Treloar et al. | 428/60 |
| 5,461,839 | A | 10/1995 | Beck | 52/519 |
| 5,465,486 | A | 11/1995 | King | 29/897.32 |
| 5,465,543 | A | 11/1995 | Seifert | 52/309.8 |
| 5,475,963 | A | 12/1995 | Chelednik | 52/545 |
| 5,482,667 | A | 1/1996 | Dunton et al. | 264/136 |
| 5,502,940 | A | 4/1996 | Fifield | 52/309.12 |
| 5,537,791 | A | 7/1996 | Champagne | 52/520 |
| 5,542,222 | A | 8/1996 | Wilson et al. | |
| 5,548,940 | A | 8/1996 | Baldock | 53/430 |
| 5,551,204 | A | 9/1996 | Mayrand | 52/795.1 |
| 5,560,170 | A | 10/1996 | Ganser et al. | 52/539 |
| 5,564,246 | A | 10/1996 | Champagne | 52/548 |
| 5,565,056 | A | 10/1996 | Lause et al. | 156/243 |
| 5,575,127 | A | 11/1996 | O'Neal | 52/520 |
| 5,581,970 | A | 12/1996 | O'Shea | 52/718.01 |
| 5,586,415 | A | 12/1996 | Fisher et al. | 52/58 |
| 5,598,677 | A | 2/1997 | Rehm, III | 52/407.1 |
| 5,613,337 | A | 3/1997 | Plath et al. | 52/533 |
| 5,622,020 | A | 4/1997 | Wood | 52/546 |
| 5,634,314 | A | 6/1997 | Champagne | 52/712 |
| 5,651,227 | A | 7/1997 | Anderson | 52/520 |
| 5,661,939 | A | 9/1997 | Coulis et al. | 52/519 |
| 5,662,977 | A | 9/1997 | Spain et al. | 428/42.1 |
| 5,664,376 | A | 9/1997 | Wilson et al. | |
| 5,675,955 | A | 10/1997 | Champagne | 52/521 |
| 5,678,367 | A | 10/1997 | Kline | 52/211 |
| 5,694,728 | A | 12/1997 | Heath, Jr. et al. | 52/554 |
| 5,720,114 | A | 2/1998 | Guerin | 33/451 |
| 5,729,946 | A | 3/1998 | Beck | 52/520 |
| 5,737,881 | A | 4/1998 | Stocksieker | 52/90.1 |
| 5,765,333 | A | 6/1998 | Cunningham | 52/481.1 |
| 5,768,844 | A | 6/1998 | Grace, Sr. et al. | 52/529 |
| 5,791,093 | A | 8/1998 | Diamond | 52/36.5 |
| 5,806,185 | A | 9/1998 | King | 29/897.32 |
| 5,809,731 | A | 9/1998 | Reiss | 52/533 |
| 5,829,206 | A | 11/1998 | Bachman | 52/94 |
| 5,836,113 | A | 11/1998 | Bachman | 52/94 |
| D402,770 | S | 12/1998 | Hendrickson et al. | D25/141 |
| 5,857,303 | A | 1/1999 | Beck et al. | 52/520 |
| 5,858,522 | A | 1/1999 | Turk et al. | |
| 5,866,054 | A | 2/1999 | Dorchester et al. | |
| 5,866,639 | A | 2/1999 | Dorchester et al. | 523/171 |
| 5,869,176 | A | 2/1999 | Dorchester et al. | |
| 5,878,543 | A | 3/1999 | Mowery | 52/519 |
| 5,946,876 | A | 9/1999 | Grace, Sr. et al. | 52/520 |
| 5,956,914 | A | 9/1999 | Williamson | 52/520 |
| 5,966,880 | A * | 10/1999 | Bridges et al. | 52/211 |
| 5,974,756 | A | 11/1999 | Alvarez et al. | 52/553 |
| 6,029,415 | A | 2/2000 | Culpepper et al. | 52/522 |
| 6,035,587 | A | 3/2000 | Dressler | 52/97 |
| 6,047,507 | A * | 4/2000 | Lappin et al. | 52/212 |
| 6,050,041 | A | 4/2000 | Mowery et al. | 52/520 |
| 6,086,997 | A | 7/2000 | Patel et al. | 428/355 BL |
| D429,009 | S | 8/2000 | Ginzel | D25/136 |
| 6,122,877 | A | 9/2000 | Hendrickson et al. | 52/520 |
| 6,161,354 | A | 12/2000 | Gilbert et al. | 52/520 |
| 6,187,424 | B1 | 2/2001 | Kjellqvist et al. | 428/220 |
| 6,195,952 | B1 | 3/2001 | Culpepper et al. | 52/522 |
| 6,223,488 | B1 | 5/2001 | Pelfrey et al. | 52/302.1 |
| 6,233,890 | B1 | 5/2001 | Tonyan | |
| 6,263,574 | B1 | 7/2001 | Lubker, II et al. | 29/897.32 |
| 6,272,797 | B1 | 8/2001 | Finger | 52/94 |
| D447,820 | S | 9/2001 | Grace | D25/119 |
| 6,282,858 | B1 | 9/2001 | Swick | 52/533 |
| D448,865 | S | 10/2001 | Manning | D25/141 |
| 6,295,777 | B1 | 10/2001 | Hunter et al. | 52/519 |
| D450,138 | S | 11/2001 | Barber | D25/141 |
| 6,321,500 | B1 | 11/2001 | Manning et al. | 52/555 |
| 6,336,988 | B1 | 1/2002 | Enlow et al. | 156/238 |
| 6,348,512 | B1 | 2/2002 | Adriani | 521/85 |
| D454,962 | S | 3/2002 | Grace | D25/119 |
| 6,358,585 | B1 | 3/2002 | Wolff | 428/36.6 |
| 6,360,508 | B1 * | 3/2002 | Pelfrey et al. | 52/520 |
| 6,367,220 | B1 | 4/2002 | Krause et al. | 52/512 |
| 6,393,792 | B1 | 5/2002 | Mowery et al. | |
| 6,442,912 | B1 | 9/2002 | Phillips et al. | 52/741.4 |
| 6,516,577 | B2 | 2/2003 | Pelfrey et al. | 52/302.1 |
| D471,292 | S | 3/2003 | Barber | D25/141 |

| | | | | |
|---|---|---|---|---|
| 6,526,718 | B2 | 3/2003 | Manning et al. | 52/555 |
| 6,539,675 | B1 | 4/2003 | Gile | 52/96 |
| 6,594,965 | B2 | 7/2003 | Coulton | 52/302.1 |
| 6,625,939 | B1 | 9/2003 | Beck et al. | 52/105 |
| D481,804 | S | 11/2003 | Pelfrey | D25/119 |
| 6,673,868 | B2 | 1/2004 | Choulet | 525/70 |
| 6,716,522 | B2 | 4/2004 | Matsumoto et al. | |
| 6,752,941 | B2 | 6/2004 | Hills | |
| 6,784,230 | B1 | 8/2004 | Patterson et al. | 524/13 |
| 6,857,232 | B2 * | 2/2005 | Bealko | 52/211 |
| 6,883,288 | B1 * | 4/2005 | Harbin | 52/521 |
| 6,988,345 | B1 * | 1/2006 | Pelfrey et al. | 52/519 |
| 7,467,500 | B2 | 12/2008 | Fairbanks et al. | |
| 2001/0041256 | A1 | 11/2001 | Heilmayr | 428/318.6 |
| 2002/0018907 | A1 | 2/2002 | Zehner | 428/537.1 |
| 2002/0020125 | A1 | 2/2002 | Pelfrey et al. | 52/302.1 |
| 2002/0025420 | A1 | 2/2002 | Wanat et al. | 428/213 |
| 2002/0029537 | A1 | 3/2002 | Manning et al. | 52/518 |
| 2002/0054996 | A1 | 5/2002 | Rheenen | 428/420 |
| 2002/0056244 | A1 | 5/2002 | Hertweck | 52/520 |
| 2002/0076544 | A1 | 6/2002 | DeWorth et al. | 428/317.1 |
| 2002/0078650 | A1 | 6/2002 | Bullinger et al. | 52/539 |
| 2002/0090471 | A1 | 7/2002 | Burger et al. | 428/15 |
| 2002/0108327 | A1 | 8/2002 | Shaw | 52/211 |
| 2002/0177658 | A1 | 11/2002 | Tajima et al. | 525/85 |
| 2003/0014936 | A1 | 1/2003 | Watanabe | 52/518 |
| 2003/0056458 | A1 | 3/2003 | Black et al. | 52/541 |
| 2003/0131551 | A1 | 7/2003 | Mollinger et al. | 52/518 |
| 2003/0154664 | A1 | 8/2003 | Beck et al. | 52/105 |
| 2004/0003566 | A1 | 1/2004 | Sicuranza | 52/518 |
| 2004/0026021 | A1 | 2/2004 | Groh et al. | 156/244.12 |
| 2004/0142157 | A1 | 7/2004 | Melkonian | 428/292.1 |
| 2005/0081468 | A1 | 4/2005 | Wilson et al. | |
| 2006/0053740 | A1 | 3/2006 | Wilson et al. | |

FOREIGN PATENT DOCUMENTS

| | | | |
|---|---|---|---|
| CA | 2267000 | | 4/2003 |
| CL | 3.856 | | 5/2001 |
| DE | 4 01 04 760.1 | | 5/2001 |
| EP | 1086 988 | A1 | 3/2001 |
| GB | 1068202 | | 5/1967 |
| GB | 2101944 | | 8/2001 |
| JP | 364001539 | A | 1/1989 |
| JP | 09141752 | A | 6/1997 |
| JP | 410018555 | A | 1/1998 |
| JP | 02001079951 | A | 3/2001 |
| KR | 321694 | | 3/2003 |
| PL | 4115 | | 7/2004 |
| WO | WO 00/55446 | | 9/2000 |

* cited by examiner

WINDOW SILL AND TRIM CORNER ASSEMBLY

This application claims the benefit of U.S. Provisional Application No. 60/510,744, filed Oct. 9, 2003, which is hereby incorporated by reference in its entirety.

BACKGROUND AND SUMMARY OF THE INVENTION

The present invention relates generally to trim components and trim assemblies. An exemplary embodiment of a trim assembly may be used to frame an opening such as a door or a window in a wall or other type of structure. An example of a trim component is a window sill or a lineal.

A need exists for a trim component and trim assembly having improved functionality and aesthetics. A need also exists for a trim component and a trim assembly that is comprised of a synthetic material such as, but not limited to, a plastic compound (e.g., a vinyl compound), a cellulosic-filled plastic composite, an inorganic-filled plastic composite, or other plastic materials. Exemplary embodiments of the present invention may satisfy one or more of these needs.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

Figure 1:
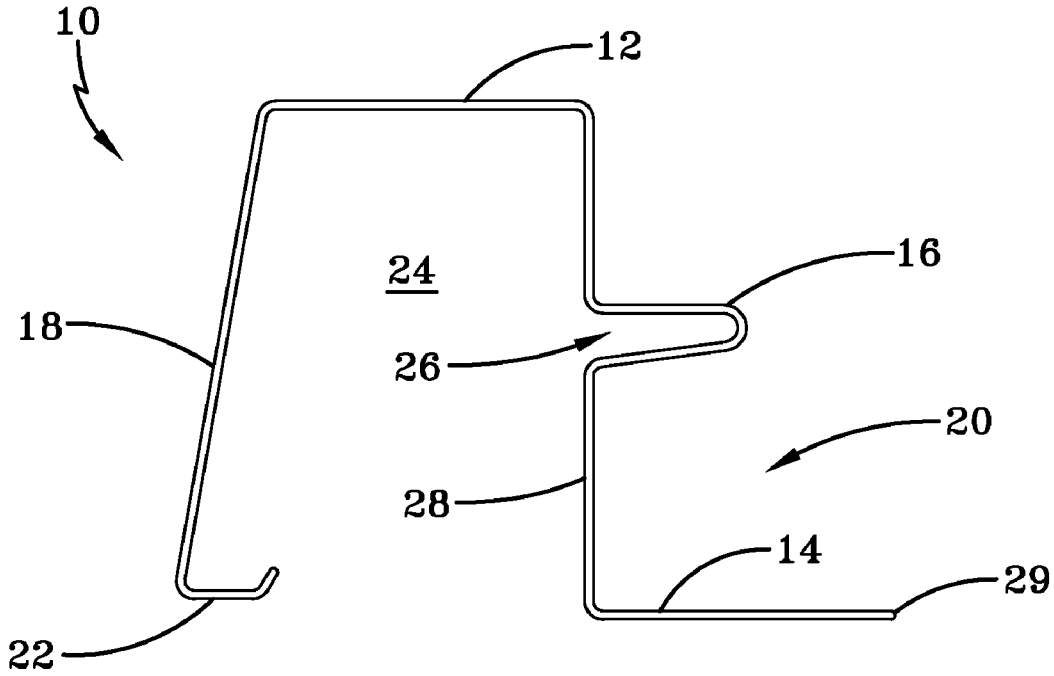
FIG. 1 is a side elevation view of an exemplary embodiment of a window sill of the present invention.
Figure 2:
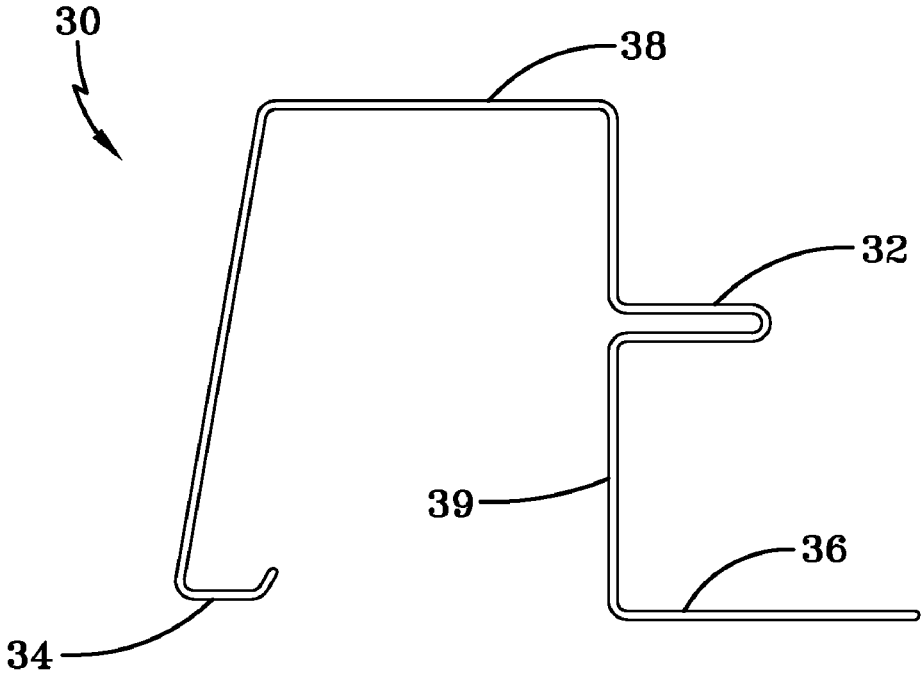
FIG. 2 is a side elevation view of another exemplary embodiment of a window sill of the present invention.

The present invention is directed to a window sill and a trim corner assembly. FIGS. 1 and 2 show exemplary embodiments of window sills of the present invention. Some exemplary embodiments of the components of the present invention may be made from any known, suitable, or conventional vinyl composition(s). For example, a window sill may be comprised of a vinyl substrate layer and an optional vinyl capstock layer. The vinyl composition(s) may include one or more additives. For instance, the vinyl composition(s) may include one or more additives to improve processing, durability, weatherability, resistance to ultraviolet (UV) degradation, impact resistance, and other qualities of window sills. An example of a weathering agent is titanium dioxide, and examples of a vinyl substrate composition and a vinyl capstock composition are polyvinyl chloride (PVC) compositions. For instance, exemplary compositions may include the following ingredients in about the following amounts (parts by weight):

| VINYL SUBSTRATE COMPOSITION | |
|---|---|
| PVC resin | 100 |
| Tin Stabilizer(s) | 0.5-2.0 |
| Processing Aid(s) | 0-2.0 |
| Lubricant(s) | 1.5-3.5 |
| Impact Modifier(s) | 2.0-6.0 |
| Mineral Filler(s) | 0-12 |
| Weathering Agent(s) | 0.5-12 |
| Colorant(s) | As Desired |

| VINYL CAPSTOCK COMPOSITION | |
|---|---|
| PVC resin | 100 |
| Tin Stabilizer(s) | 0.5-2.0 |
| Processing Aid(s) | 0-2.0 |
| Lubricant(s) | 1.5-3.5 |
| Impact Modifier(s) | 2.0-6.0 |
| Weathering Agent(s) | 9-11 |
| Colorant(s) | As Desired |

Alternative embodiments of the components may be made from other extrudable or moldable plastic materials. For example, the window sills of the present invention may also be made from polystyrene, acrylonitrile-butadiene-styrene (ABS), nylon, ethylene-vinyl acetate (EVA), polycarbonate, polyethylene (PE), polypropylene (PP), polyethylene terephthalate (PET), thermoplastic olefins, acrylonitrile-styrene-acrylic (ASA), other similar or conventional plastics, and alloys, blends, and coextrusions of these resins. In addition, the components of the present invention may be made from cellulosic-filled and/or inorganic-filled plastic composites. It should also be recognized that the components of the present invention may be made from foamed plastics including, but not limited to, foamed plastic composites.

FIGS. 1 and 2 show examples of window sills 10 and 30, respectively. For the sake of simplicity, the invention will be described primarily with regard to FIG. 1. The window sill 10 has a face portion 12, a side portion 28, and flange 14. The flange has a terminal end 29. The side portion 28 may run between the face portion 12 and the flange 14, and it may have a protruding portion 16 disposed thereon. The protruding portion 16 is situated between the face portion 12 and the flange 14. The protruding portion extends from the side portion 28 towards the terminal end 29 of the flange 14. In some exemplary embodiments, the flange 14 may assist in securing the window sill 10 to a structure. For example, the flange 14 may include at least one aperture (such as aperture 98 in FIG. 7) for receiving mechanical fasteners such as screw or nails.

The protruding portion 16 may extend at least partially over the flange 14. For example, the flange 14 and the protruding portion 16 may both extend away from an opposing side portion 18, thereby forming a channel 20. The channel 20 may be adapted to receive siding, panels, masonry, or other portions of a wall or structure to which the window sill 10 may be secured. The protruding portion 16 may partially obscure the view of the top edge of the wall or structure that may be received in the channel 20, which may result in an improved appearance of the overall assembly. Alternatively, the flange 14 may extend toward the opposing side portion 18 in other embodiments of the present invention.

The side portion 18 extends rearwardly from the face portion 12. In this example, the side portion 18 is connected to a distal portion of the face portion 12 relative to the protruding portion 16. In addition, the side portion 18 extends from the face portion 12 at an angle in this example. A distal portion 22 of the side portion 18 may be angled toward the interior 24 of the window sill 10. Such as explained below, the distal portion 22 may assist in securing the window sill 10 to an underlying structure. In this exemplary embodiment, the interior 24 of the window sill 10 is hollow. However, the window sill 10 may be solid or filled with material including, but not limited to, a foam material.

In this example, the protruding portion 16 defines a channel 26. The channel 26 is open toward the interior 24 of the window sill 10. The channel 26 may be adapted to receive another component such as a trim component (e.g., a lineal that extends around a window in a structure) in a trim corner assembly.

In FIG. 2, the window sill 30 differs from the window sill 10 in the configuration of the protruding portion 32, which extends from the side portion 39, and the distal portion 34. In this exemplary embodiment, the protruding portion 32, the flange 36, and the face portion 38 extend in respective planes that are substantially parallel.

Figure 3:
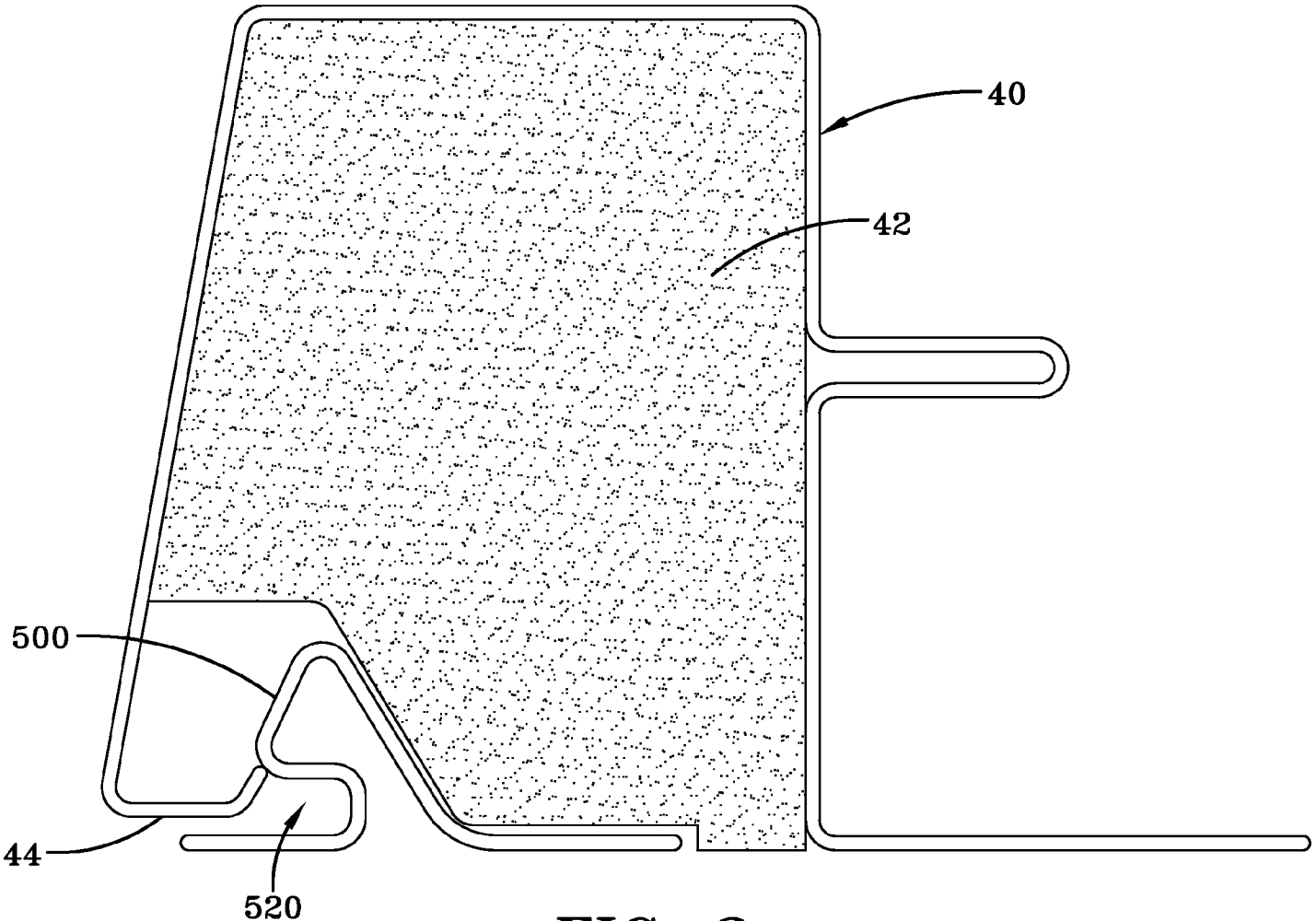
FIG. 3 is a side elevation view of exemplary embodiments of another window sill and a starter strip of the present invention.

FIG. 3 shows an example of another embodiment of a window sill 40 of the present invention. As shown in this example, a component of the present invention may be partially or completely filled with a reinforcement material 42. Examples of reinforcement material include polyurethane foam, polystyrene foam, other foams, and other types of reinforcement material.

Figure 4:
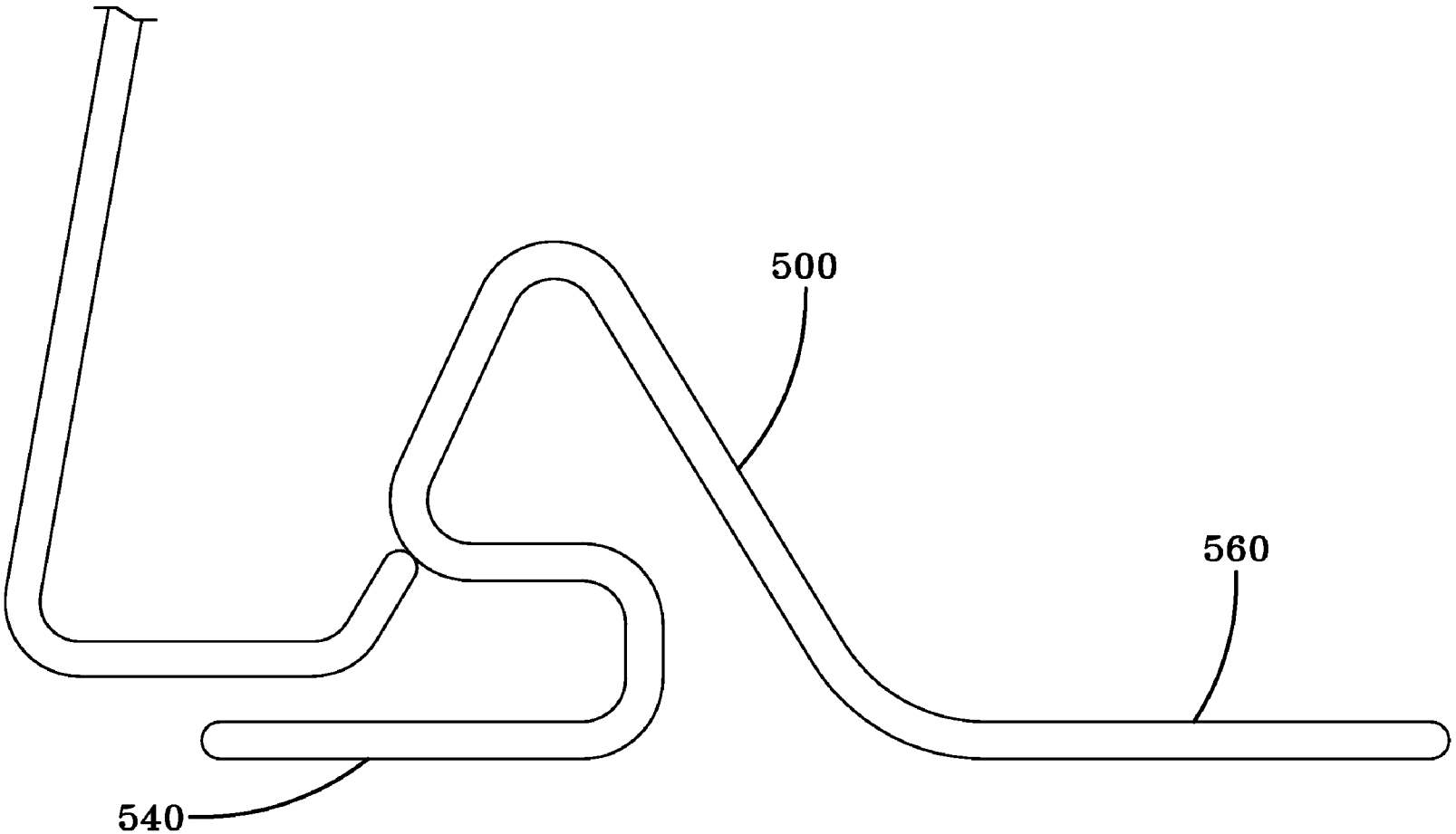
FIG. 4 is a partial side elevation view of exemplary embodiments of another window sill and another starter strip of the present invention.
Figure 5B:
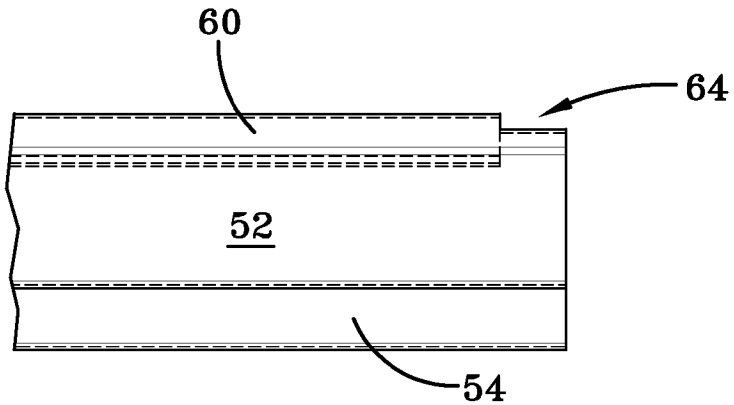
FIG. 5B shows a top plan view of the window sill of FIG. 5A.
Figure 5A:
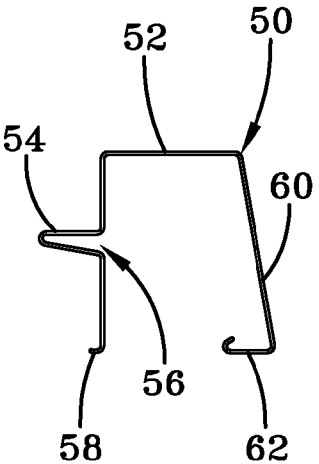
FIG. 5A shows a first side elevation view of another exemplary embodiment of a window sill of the present invention.
Figure 5C:
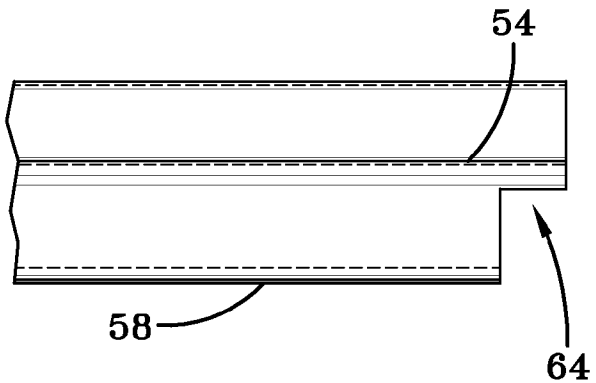
FIG. 5C shows a second side elevation view of the window sill of FIG. 5A.
Figure 5D:
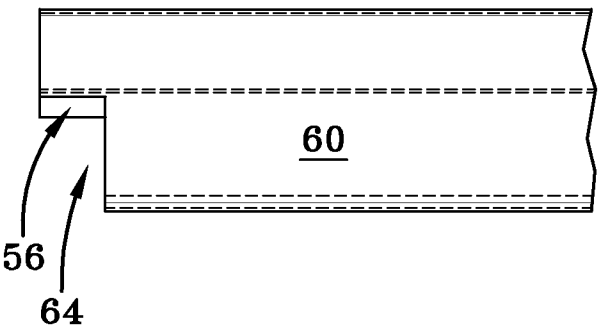
FIG. 5D shows a third side elevation view of the window sill of FIG. 5A.

FIGS. 3 and 4 also show an example of a starter strip 500. The starter strip 500 may engage a portion of a window sill upon installation, thereby assisting in securing the window sill in position. For example, referring to FIG. 3, the starter strip 500 may define a channel 520 that is adapted to receive a distal portion 44 of the window sill 40. In addition, referring to FIG. 4, flange 540 and/or flange 560 of starter strip 500 may include apertures for receiving mechanical fasteners to secure the starter strip 500 to an underlying structure.

FIGS. 5A through 5D show multiple views of another embodiment of a window sill 50 of the present invention. The window sill 50 includes a face portion 52, a protruding portion 54 that defines a channel 56, a flange 58, and a side portion 60 that has a distal portion 62. In this embodiment, the flange 58 extends only a minimal distance. In fact, it should be recognized that some embodiments of the present invention may not even include such a flange. Referring to general area 64, a portion of the side portion 60 may be cut away, removed, or otherwise absent in order to facilitate access to channel 56. This may facilitate connection with another component such as a trim component (e.g., a lineal).

Figure 6C:
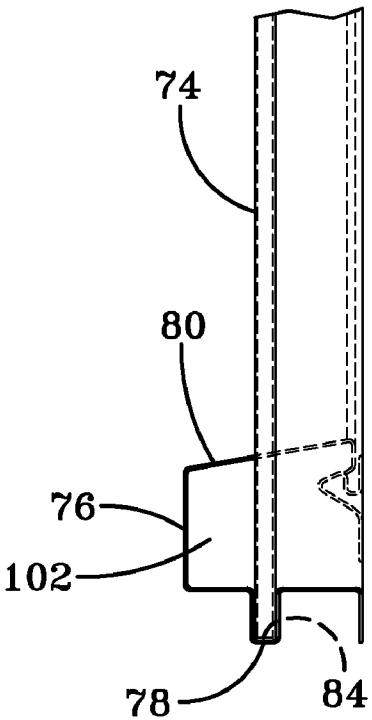
FIG. 6C shows a third side elevation view of the trim corner assembly of FIG. 6A
Figure 6A:
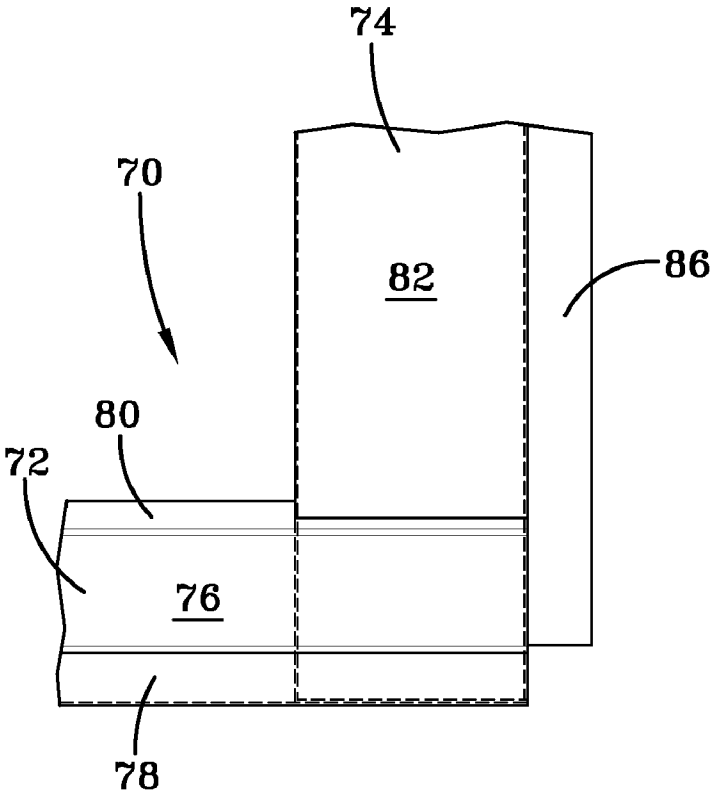
FIG. 6A shows a first side elevation view of an exemplary embodiment of a trim corner assembly of the present invention.
Figure 6B:
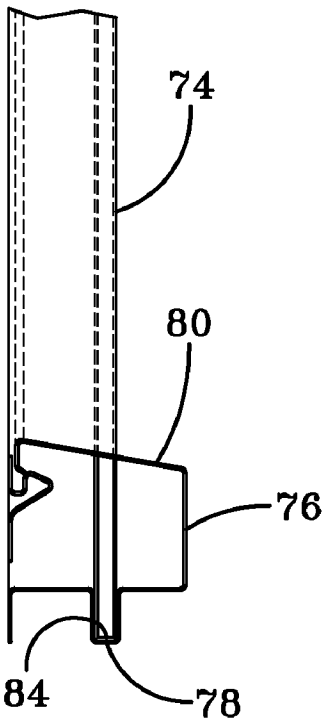
FIG. 6B shows a second side elevation view of the trim corner assembly of FIG. 6A.

FIGS. 6A through 6C show an example of a trim assembly 70. The trim assembly may utilize a window sill 72 such as described herein. For reference, the window sill 72 has a face portion 76, a protruding portion 78, and a side portion 80. In this example, a lineal component 74 extends into the interior of the window sill 72. The lineal component has a face portion 82, an edge 84, and a flange 86. The face portion 82 extends behind the face portion 76 of the window sill 72. The edge 84 extends into a channel defined by protruding portion 78 of window sill 72, thereby forming a trim corner assembly 70.

Figure 7:
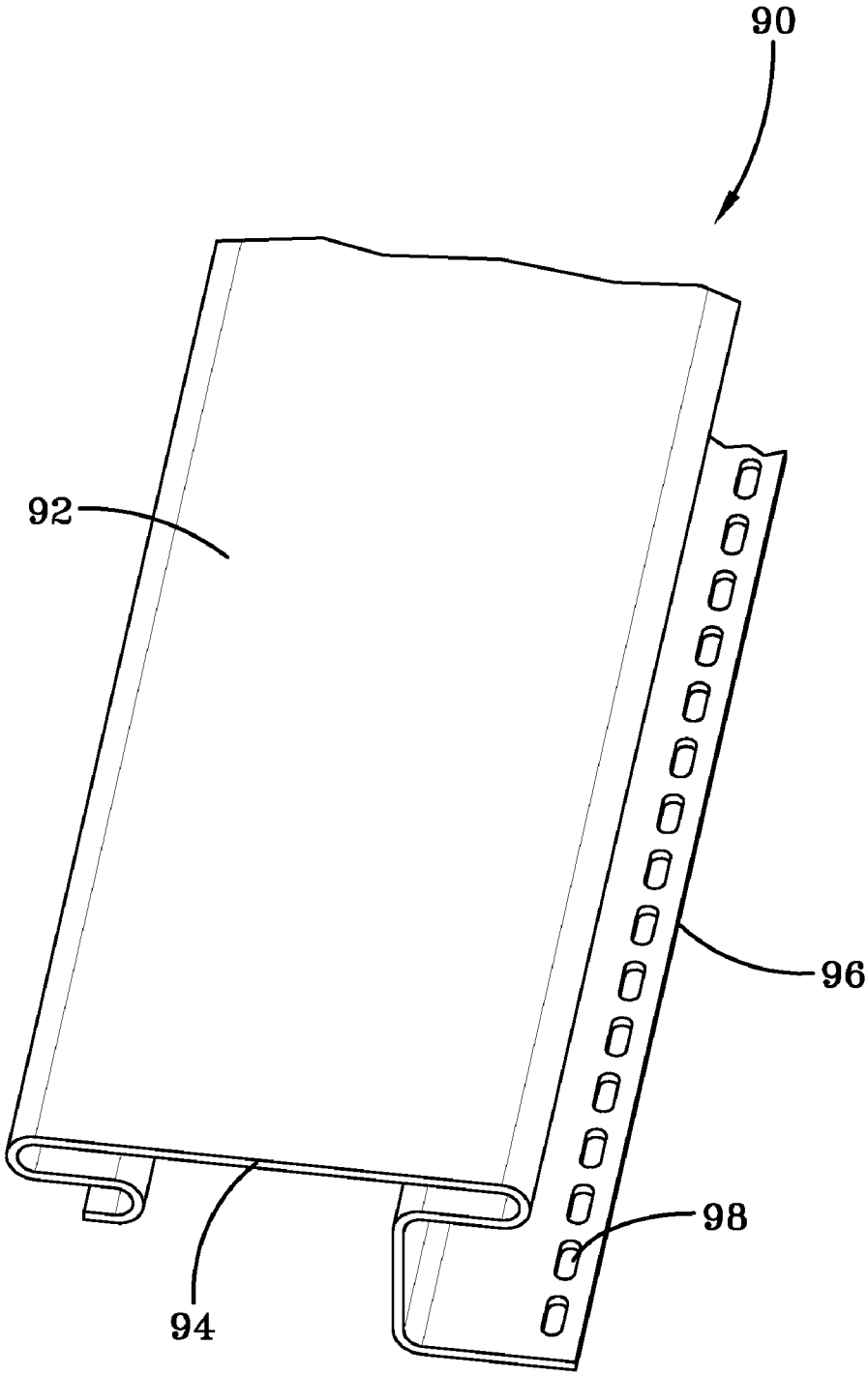
FIG. 7 is a perspective view of an exemplary embodiment of a lineal.

Another example of a lineal 90 is shown in FIG. 7. The lineal 90 is comprised of a face portion 92, an edge 94, and a flange 96. Portions of the edge 94 may be cut away, removed, or otherwise absent to facilitate a desired connection with a window sill.

Figure 8:
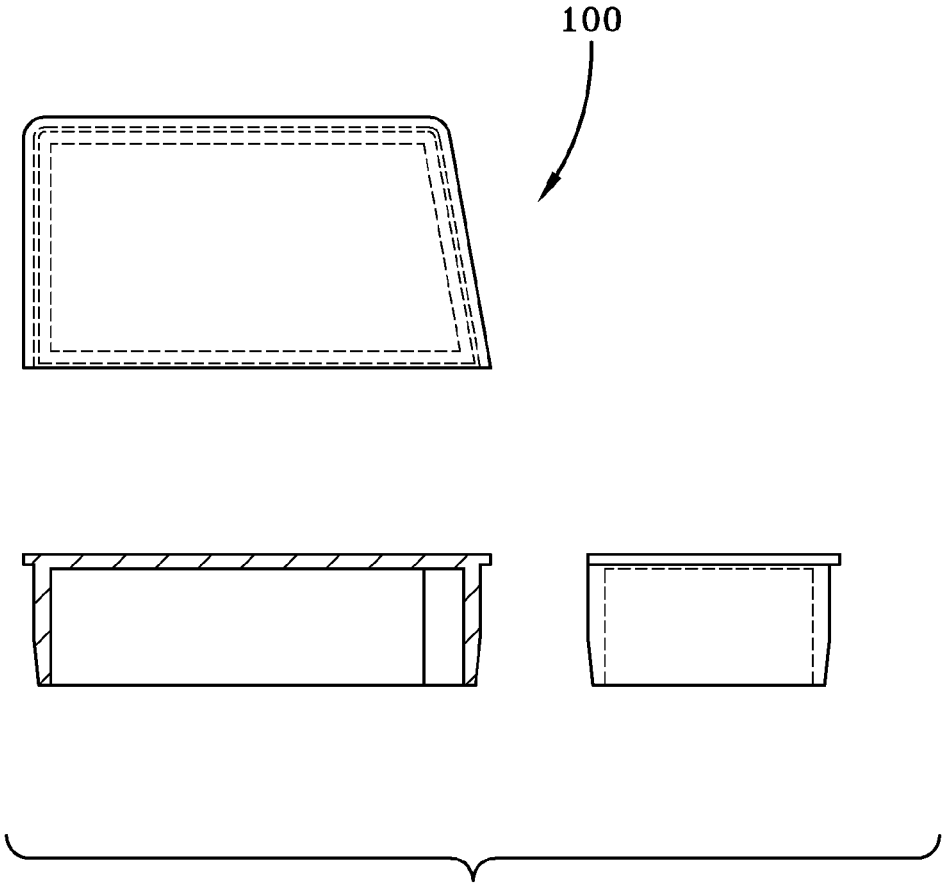
FIG. 8 shows multiple views of an exemplary embodiment of an end cap of the present invention.

An exemplary embodiment of an end cap 100 is shown in FIG. 8. The end cap 100 may be inserted in or around the end portion of a window sill. FIG. 6 shows an example in which an end cap may be inserted into the outer end of the window sill adjacent to the lineal (i.e., in area 102). The end cap may be secured to the window sill by any suitable means such as a friction fit, a snap fit, by mechanical means, or by adhesives. The end cap 100 may serve several purposes such as for improving the aesthetics or keeping water or insects out of the interior of the window sill.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A window sill comprising:

a flange having at least one aperture adapted to receive a fastener for securing said window sill to an underlying structure;

a face portion having a proximal portion and a distal portion; and a protruding portion disposed upon a side portion situated between said flange and said proximal portion of said face portion so that said side portion extends between the protruding portion and the proximal portion of the face portion and between the protruding portion and the flange, said protruding portion and said flange respectively extending from said side portion in a direction away from said distal portion of said face portion such that said protruding portion extends at least partially over said flange.

2. The window sill of claim 1 wherein said window sill is a hollow profile.

3. The window sill of claim 2 further comprising a foam filler situated in said hollow profile.

4. The window sill of claim 1 wherein said window sill is comprised of a vinyl material.

5. The window sill of claim 1 wherein said flange and said protruding portion define a channel.

6. The window sill of claim 1 wherein said flange, said face portion, and said protruding portion extend in respective planes that are substantially parallel.

7. The window sill of claim 1 further comprising a second side portion rearwardly extending from said face portion, said second side portion connected to said distal portion of said face portion relative to said protruding portion.

8. The window sill of claim 7 wherein a distal portion of said second side portion relative to said face portion is angled toward an interior of said window sill.

9. The window sill of claim 1 wherein:

said side portion between said proximal portion of said face portion and said protruding portion is substantially orthogonal to said face portion; and said side portion between said protruding portion and said flange is substantially orthogonal to said flange.

10. A trim corner assembly comprising:

a first component comprising:

a flange having at least one aperture adapted to receive a fastener for securing said first component to an underlying structure;

a face portion having a proximal portion and a distal portion; and a protruding portion disposed upon a side portion situated between said flange and said proximal portion of said face portion so that said side portion extends between the protruding portion and the proximal portion of the face portion and between the protruding portion and the flange, said protruding portion defining a channel in an interior of said first component, said protruding portion and said flange respectively extending from said side portion such that said protruding portion extends at least partially over said flange; and a second component having a face portion, said face portion of said second component extending behind said face portion and through said interior of said first component and into said channel.

11. The trim corner assembly of claim 10 wherein:

said first component is a window sill; and said second component is a lineal.

12. The trim corner assembly of claim 10 wherein:

said side portion between said proximal portion of said face portion and said protruding portion is substantially orthogonal to said face portion; and said side portion between said protruding portion and said flange is substantially orthogonal to said flange.

* * * * *

UNITED STATES PATENT AND TRADEMARK OFFICE

CERTIFICATE OF CORRECTION

PATENT NO. : 7,726,092 B1
APPLICATION NO. : 10/963989
DATED : June 1, 2010
INVENTOR(S) : Pelfrey et al.

It is certified that error appears in the above-identified patent and that said Letters Patent is hereby corrected as shown below:

On the title page, in section (56), References Cited, OTHER DOCUMENTS, please insert -- 1. Sweet's General Building & Renovation, 1995 Catalog File; section 07460 on Siding, pp. 4-20.

2. Web site print outs from www.dupontdow.com, "Adhesives," August 12, 2000, 3 pages.

3. Web site print outs from www.dupontdow.com, "Neoprene – Grades of Neoprene – AquaStikTM Water Based Polychloroprene." August 12, 2000, 2 pages.

4. Web site print outs from www.dupontdow.com, "Neoprene – Grades of Neoprene – Neoprene Solid Grades for Solvent-Based Adhesives." August 12, 2000, 2 pages.

5. "New Craneboard sold core siding redefines home exterior siding," Crane Performance Siding news release online, March 20, 2001, 3 pages.

6. Jim Weiker, "Crane puts new face on siding," The Columbus Dispatch, May 9, 2002, 3 pages.

7. Innovations for Living, "What Do I Look For in Quality Vinyl Siding?" Owens Corning, November 9, 2002, 1 page.

8. Crane in the News, International Builders' Show Preview, January/February 2003, 1 page.

9. Mark Feirer, "Vinyl Siding, Love it or hate it, plastic is here to stay," This Old House Online, no date, 8 pages. --

Signed and Sealed this

Thirteenth Day of July, 2010

David J. Kappos

David J. Kappos
*Director of the United States Patent and Trademark Office*